US005220351A

United States Patent [19]

Martin et al.

[11] Patent Number: 5,220,351

[45] Date of Patent: Jun. 15, 1993

[54] METHOD FOR MINIMIZING CURL OF TRANSPARENT MEDIA DURING PRINTING OF HIGH DENSITY THERMAL DYE TRANSFER IMAGES

[75] Inventors: Thomas W. Martin, Rochester; Marcello D. Fiscella, Fairport; William D. Goodwin, Rochester, all of N.Y.

[73] Assignee: Eastman Kodak Company, Rochester, N.Y.

[21] Appl. No.: 740,173

[22] Filed: Aug. 5, 1991

[51] Int. Cl.[5] ..... B41J 2/32

[52] U.S. Cl. ..... 346/76 PH; 346/1.1

[58] Field of Search ..... 346/76 PH, 1.1

[56] References Cited

U.S. PATENT DOCUMENTS

| | | | |
|---|---|---|---|
| 4,505,603 | 3/1985 | Yana | 400/120 |
| 4,605,938 | 8/1986 | Matsuno et al. | 346/76 |
| 4,795,999 | 1/1989 | Takahashi et al. | 346/76 PH |
| 4,892,994 | 1/1990 | Tsuchiya et al. | 219/216 |
| 4,913,330 | 4/1990 | Takahashi | 226/196 |
| 4,973,985 | 11/1990 | Genno et al. | 316/76 |
| 4,985,711 | 1/1991 | Nakamura et al. | 346/76 |
| 5,055,884 | 10/1991 | Ndebi et al. | 355/288 |

FOREIGN PATENT DOCUMENTS

| | | | |
|---|---|---|---|
| 0127263 | 6/1987 | Japan | 400/120 MP |

*Primary Examiner*—Benjamin R. Fuller
*Assistant Examiner*—N. Le
*Attorney, Agent, or Firm*—Raymond L. Owens

[57] ABSTRACT

A method for controlling the curl of high density images on transparent media is provided for thermal dye transfer printers. The method includes wrapping the transparent receiver media around the print drum a preselected amount during printing. For a mechanical drive printer, the amount of wrapping is about 210 degrees. For capstan drive systems, the degree of wrapping is about 90 to about 160 degrees.

9 Claims, 1 Drawing Sheet

METHOD FOR MINIMIZING CURL OF TRANSPARENT MEDIA DURING PRINTING OF HIGH DENSITY THERMAL DYE TRANSFER IMAGES

BACKGROUND OF THE INVENTION

1. Technical Field

This invention relates generally to thermal printers and, more particularly, relates to a method for minimizing curling of transparent media during printing.

2. Background Art

To produce a high quality continuous tone print using the thermal printing process, a dye donor sheet in dye transferring contact with a dye receiver sheet is passed through the nip formed between a thermal print head and the transfer print drum. Dye is transferred from the dye donor into the receiver layer that may be coated up on either a reflective support, if it is desired to directly view the images, or upon a transparent support if the image is to be projected. The reflective receiver sheet may be comprised of any opaque substrate sheet such as paper, synthetic paper, or resin coated paper with a dyeable polymer or resin coated upon one surface. The transparent receiver sheet may be comprised of any light transmissive substrate such as polyester film coated with a dye receiving layer upon one surface. When image formation is effected using these receiver sheets, warping of the receiver sheet occurs.

This warping is referred to as curl and is the result of heating the surface of the receiver sheet nearer the thermal head during dye transfer. The curl problem becomes severe as attempts are made to print transparencies with high optical image densities ($D_{max} > 1.8$) which require the support surface nearer the print head to experience temperatures significantly higher than the glass transition temperatures of most common transparent support materials employed in transparent receiver sheets. This can cause problems with the receiver sheet transport and registration when printing color images in a thermal printer. In addition, the curl of a transparent receiver affects the quality of the projected image which may be undesirable to the viewer. The preferred situation is to have the finished transparency as flat as possible when placed upon a flat surface.

Approaches to controlling curl have focused on the receiver. For example, there have been synthetic paper sheets of at least three plies, each having different Cobb sizing degrees or internal bond strength to prevent curling when used for facsimile, thermal printing, and others. Another is a paper support containing pigment and a rubbery polymer latex material providing a material that would yield reduced curl when imaged with a thermal head or heat pin. Still another curl prevention layer is known that is coated upon either surface adjacent to the substrate and is comprised of a non-heat expandable/contractible resin, preferably an acrylic resin. Addition of this layer is believed to prevent curl when the substrate is used for thermal printing. Each of these approaches, however, add additional expense to the cost of manufacturing the media because of the addition of materials and/or steps required to produce the support. Those that add materials that increase opacity are not useful in producing transparent receiver sheets. It will, therefore, be appreciated that it is highly desirable to have a transparent media that resist curling.

U.S. Pat. No. 4,892,994, which issued Jan. 9, 1990, to Masaru Tsuchiya et al., for "Curling Prevention Device of Thermal Developing Machine", attacks the curling problem after the receiver emerges from the printing zone. The curling prevention device is provided at the outlet of a thermal developing and/or transfer step and thereafter with a correcting guide passage having a bend in the opposite direction to the direction of the curling appearing in the step. The device end is adapted to permit a thermal developing light sensitive material to pass with a temperature of 50° C. at least the inlet portion of the correcting guide passage. While Tsuchiya et al. apparently minimize curling in the finished print, curling does occur, which must be removed before the final print is delivered. Accordingly, it will be appreciated that it would be highly desirable to have a method for producing transparencies that prevent the formation of curl.

U.S Pat. No. 4,505,603, which issued Mar. 19, 1985, to Masasumi Yana, for "Thermal Transfer Color Printer and a Method Relating Thereto" discloses a thermal printer and illustrates the circuitous path that the receiver media traverses during the printing process. The media traverses a portion of the print drum where the donor is brought into contact with it and the dye is transferred from the donor to the receiver under the influence of the thermal print head. Where paper media is used, curling is not a problem. Where curling is a problem, however, is with transparent media.

SUMMARY OF THE INVENTION

The present invention is directed to overcoming one or more of the problems set forth above. Briefly summarized, according to one aspect of the present invention, a method for minimizing curling of transparent media during printing in a thermal printer, comprises wrapping the transparent media about a circumference of a printer platen so that the transparent media contacts the circumference for between about 60 to about 230 degrees.

The present invention provides a method for producing high image density overhead transparencies with little to no curl by thermal dye transfer printing. Reduction or elimination of the curl is effected through the amount of wrap around the printer platen that is maintained with the receiver sheet during the printing process where the receiver is heated. The method is particularly useful in compact thermal printers wherein the printer platen diameter is less than about 1.5 inches (3.8 cm).

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
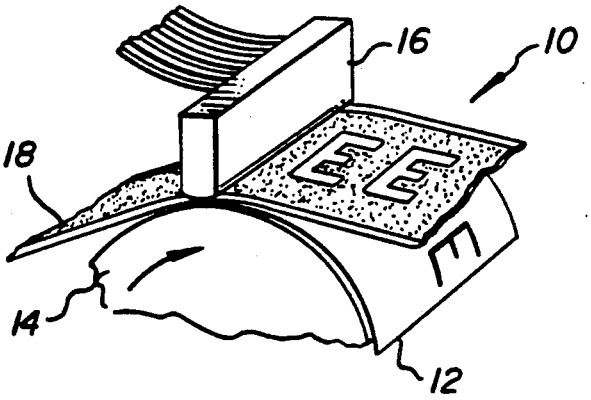
FIG. 1 is a simplified perspective view of a preferred embodiment of a thermal printer mechanism during a printing cycle illustrating the relationship between the print head, donor, receiver media and print drum.

Referring now to the drawings, in which like numerals indicate like elements throughout the several figures. FIG. 1 illustrates a thermal printer 10 including a receiver 12 and a print platform or drum 14 that supports the receiver 12 as dye is transferred to the receiver media 12. Positioned about the drum 14 is a print head 16 that has a dye bearing donor web 18 positioned in proximity to the print drum 14 for controlling a transferring dye to the receiver media 12. As is well known in the art, the print head 16 may be moved to a print position wherein the receiver 12 rests against the circumference of the drum 14. At the print position, the print head 16 is close enough to the drum to thermally transfer dye from the donor web 18 to the receiver 12 when the print head 16 is heated.

Figure 2:
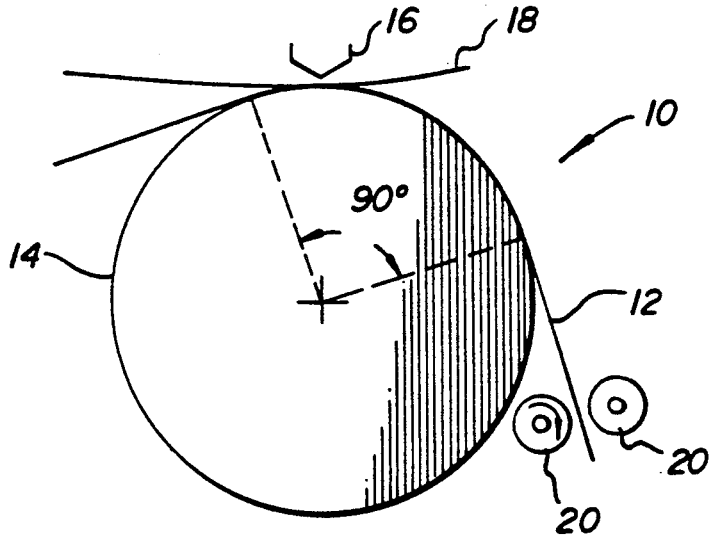
FIG. 2 is a diagrammatic side view of the thermal printer mechanism of FIG. 1 illustrating a capstan drive with the receiver media positioned about the print drum a preselected number of degrees in accordance with the present invention.

Referring to FIG. 2, the thermal printer 10 includes a capstan drive with capstan rollers 20 that engage the receiver media 12 after it emerges from the nip between the thermal print head 16 and the print drum 14. The receiver 12 is in contact with the drum 14 for about one-quarter of the distance around the drum. Measured as an angle from the center point of the drum to the circumferential edge where the receiver 12 contacts the drum 14, the angle is about 90 degrees.

Figure 3:
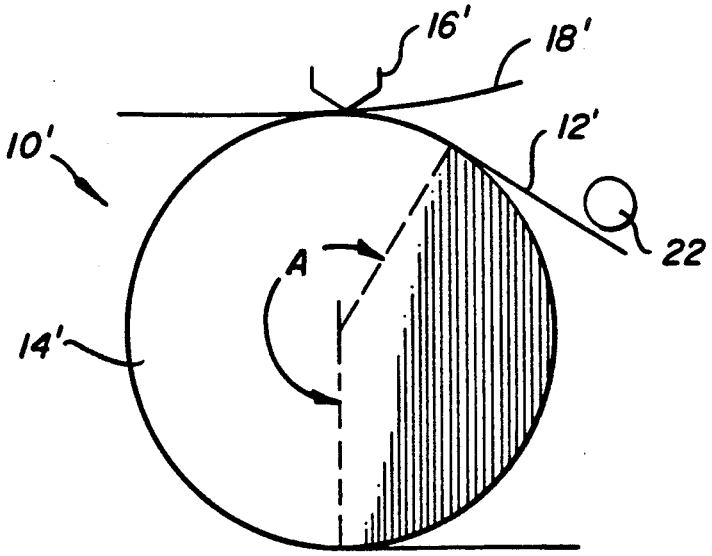
FIG. 3 is a diagrammatic side view of a thermal printer mechanism similar to FIG. 2, but illustrating an another embodiment with an E-mechanical printer mechanism with the receiver media positioned about the print drum.

Referring to FIG. 3, the thermal printer 10' has a mechanical drive with rollers 22 that engage the receiver media 12' as the media 12' emerges from the nip between the thermal print head 16' and the print drum 14'. The angle "A" is the angle the receiver 12' is wrapped around the circumference of the print drum 14' as measured from the center of the drum 14' to the circumferential edge of the drum where the receiver 12' makes tangential contact with the drum 14'. As illustrated, the receiver 12' is wrapped around the print drum 14' for a little over half of the circumferential distance or approximately 210 degrees.

The present invention provides a method for producing high image density overhead transparencies with little to no curl by thermal dye transfer printing. Reduction or elimination of the curl is effected through the amount of wrap around the printer platen that is maintained with the receiver sheet during the printing process where the receiver is heated. The method is particularly useful when the printer platen diameter is less than about 1.5 inches (3.8 cm).

A variety of receiver sheets printed both with and without wrap around a printer platen, and both with and without tension applied to the receiver sheet through a printer have been tested. In the tests, the product polyethyleneteraphthalate, sold under the trademark "ESTAR" was used as the transparency base. ESTAR polyethyleneteraphthalate supports were coated with receiver formulations. ESTAR polyethyleneteraphthalate supports of 4.0, 4.7, 5.0 and 7.0 mil thicknesses were evaluated for the amount of curl produced when printed in each configuration tested. In addition, control samples were printed in a device that provided no wrap around the printer platen during the printing process (sensitometer). A uniform area, 8×9.6 inches (20.3×24.4 cm) was printed to a neutral transmission density of 2.3 on each sample. The receiver sheet dimensions were page size, 8.5×11 inches (21.6×27.9 cm). The amount of curl was determined after printing by placing the sample upon a flat surface, measuring the distances from the flat surface to the four corners and averaging. Curl toward the image side is considered positive, and curl away from the image side is considered negative. It is desirable to have no curl, but an acceptable level, by this test, would be up to about +1.25 cm (+0.5 in).

When the preferred printer mechanism is a capstan drive system with a 2.5 cm (1 in) diameter printer platen, then about 90 degrees of receiver wrap around the platen is the optimum for a minimum curl with a 4.7 or 5.0 mil polyethyleneteraphthalate based receiver sheet. When a smaller 2.0 cm (0.8 in) diameter platen is chosen, the amount of receiver wrap has to be increased to the range of around 130 degrees to obtain minimum curl with this type of printer mechanism using the same support. If a printer mechanism similar to the E-mechanical drive is chosen, a receiver wrap of about 210 degrees is necessary to achieve minimal curl with a 2.0 cm (0.8 in) diameter printer platen and a 4.7 or 5.0 mil ESTAR polyethyleneteraphthalate support receiver sheet. Although the effect of tension applied to the receiver sheet during printing is not well understood, it does allow a wider window in the amount of receiver wrap around the printer platen necessary to achieve an acceptable level of curl.

It can now be appreciated that there has been presented a method for controlling the curl of high density images on transparent media for thermal dye transfer printers. The method includes wrapping the transparent receiver media around the print drum a preselected amount during printing. For a mechanical drive printer, the optimal amount of wrapping is about 210 degrees, but wrapping anywhere from 180 to 230 degrees provides the desired flatness. For capstan drive systems with 2.5 cm (1.0 in) platens, the degree of wrapping is about 60 to 110 degrees with the optimal wrapping being about 90 degrees. On the other hand, capstan drive systems with 2.0 cm (0.8 in) platens, the degree of wrapping is about 110 to 160 degrees with the optimal wrapping being about 130 degrees.

While the invention has been described with particular reference to the preferred embodiments, it will be understood by those skilled in the art that various changes may be made and equivalents may be substituted for elements of the preferred embodiments without departing from the invention. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. A method for minimizing curling of transparent media during printing in a capstan drive thermal printer of thermal dye transfer images having an optical image density greater than 1.8, comprising the step of:

wrapping said transparent media about a circumference of a printer platen having a diameter of about 2.5 cm so that said transparent media contacts said circumference for between about 60 to about 110 degrees so that positive curl is not greater than about 1.25 cm for a letter sized sheet of said transparent media.

2. A method, as set forth in claim 1, including the step of wrapping said transparent media so that said media contacts said circumference for about 90 degrees.

3. A method, as set forth in claim 1, including the step of wrapping said transparent media so that said media contacts said circumference for about 130 degrees.

4. A method, as set forth in claim 1, wherein said transparent media has a polyethyleneteraphtalate based substrate about 4.7 to 5.0 mils thick.

5. A method for minimizing curling of transparent media during printing in a thermal printer of thermal dye transfer images having an optical image density greater than 1.8, comprising the steps of:

wrapping said transparent media about a circumference of a printer platen having a diameter of about 2.0 cm so that said transparent media contacts said circumference for between about 110 to 160 degrees so that positive curl is not greater than about 1.25 cm for a letter sized sheet of said transparent media; and urging said transparent media forward with a capstan drive mechanism.

6. A method, as set forth in claim 5, wherein said transparent media has a polyethyleneteraphtalate based substrate about 4.7 to 5.0 mils thick.

7. A method for minimizing curling of transparent media during printing in a mechanical drive thermal printer of thermal dye transfer images having an optical image density greater than 1.8, comprising the step of:

wrapping said transparent media about a circumference of a printer platen having a small diameter of about 2.0 cm so that said transparent media contacts said circumference for between about 180 to about 230 degrees so that positive curl is not greater than about 1.25 cm for a letter sized sheet of said transparent media.

8. A method, as set forth in claim 7, including the step of wrapping said transparent media so that said media contacts said circumference for about 210 degrees.

9. A method, as set forth in claim 7, wherein said transparent media has a polyethyleneteraphtalate based substrate about 4.7 to 5.0 mils thick.

* * * * *